United States Patent [19]

Malerba

[11] 4,122,421

[45] Oct. 24, 1978

[54] DEVICE FOR THE CONTROL OF ELECTRON BEAMS OF A CATHODE RAY TUBE

[75] Inventor: Mario Malerba, Turin, Italy

[73] Assignee: Indesit Industria Elettrodomestici Italiana S.p.A., Turin, Italy

[21] Appl. No.: 741,839

[22] Filed: Nov. 15, 1976

[30] Foreign Application Priority Data

Nov. 21, 1975 [IT] Italy ..... 69871 A/75

[51] Int. Cl.[2] ..... H01F 5/00

[52] U.S. Cl. ..... 335/213; 335/210

[58] Field of Search ..... 335/210, 212, 213

[56] References Cited

U.S. PATENT DOCUMENTS

| | | | |
|---|---|---|---|
| 3,701,065 | 10/1972 | Mirsch | 335/212 |
| 3,721,930 | 3/1973 | Barkow et al. | 335/213 |
| 3,906,418 | 9/1975 | Doshi et al. | 335/212 X |

*Primary Examiner*—George Harris

*Attorney, Agent, or Firm*—Sughrue, Rothwell, Mion, Zinn and Macpeak

[57] ABSTRACT

A device for controlling the convergence of the side beams of a color television picture tube having three in-line electron guns, comprising two sets of coils wound on an annular ferromagnetic support in a configuration which, when an electric current is passed through one of the sets of coils, generates a magnetic field which influences only one of the side beams causing it to deflect in one direction and when an electric current is passed through the other of the sets of coils, generates a magnetic field which influences only the other of the side beams also causing deflection thereof in the said one direction. Deflection of the two side beams in a direction orthogonal to the said one direction is achieved independently by two further sets of coils which generate magnetic fields individually influencing associated side beams to cause deflection thereof by an amount depending on the magnitude and direction of the currents flowing in the coils. Four controls individually adjusting the magnitude and direction of the current in the four sets of coils thus independently adjust the two side beams.

24 Claims, 11 Drawing Figures

DEVICE FOR THE CONTROL OF ELECTRON BEAMS OF A CATHODE RAY TUBE

Figure 1A:
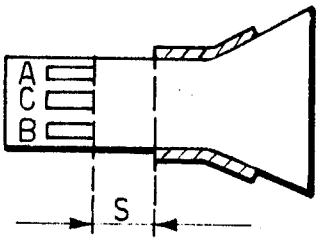

The present invention relates to a device for the control of a cathode ray tube, particularly a colour television picture tube with three electron beams, having an elongate neck along which are directed a group of three substantially coplanar electron beams. The electron beams comprise a central beam the path of which substantially coincides with the longitudinal axis of the neck of the picture tube, and two side beams the paths of which are substantially symmetrically disposed on either side of the said axis. The three coplanar beams cross at least one region within the neck of the tube which is free of any magnetisable structures. More particularly the present invention relates to magnetic units for controlling the convergence of the said electron beams.

The three electron beams of a colour television picture tube are generated by three electron guns which, in modern tubes, are aligned in such a manner as to generate beams having axes lying substantially in a common plane, the central beam being coincident with the axis of the neck of the tube, and the side beams being symmetrically disposed on opposite sides of the central beam.

For proper operation of the television picture tube it is desirable that the three electron beams should converge and strike corresponding areas of the phosphorus material of the screen of the picture tube. Although the electron gun structures of a picture tube are ideally designed to achieve such a convergence of the electron beams at the centre of the screen in the absence of any deflection of the beams, practical limitations on the production of picture tubes and associated components make it necessary to provide a picture tube with appropriate means for the correction of a range of non-convergence errors at the centre of the screen which can occur in practice.

Normally controllable magnetic fields are used to effect the necessary adjustments required for static convergence, whilst a typical unit, which can be used both for in-line guns configuration and delta gun configurations, has involved the use of controllable magnets in association with polar expansion structures for adjusting the convergence of the beam. In some known constructions these are located externally of the neck of the picture tube and in others within the neck of the picture tube. The presence of magnetic polar expansion structures for the purposes of convergence of the beam, in close proximity to the region of the neck of the tube surrounded by the deflection yoke, presents difficulties due to undesirable interactions between the magnetic fields associated with the two structures.

A controllable magnet unit capable of producing the static convergence of the beam in a television picture tube of the type having in-line guns, which does not require polar expansion structures, is described, for example, in Italian Pat. No. 973257. The device described in this patent creates controllable magnetic fields which have different characteristics at different regions within the neck of the picture tube; a first component of the field intersects, in opposite directions, the two side beams while having a negligible field strength in the region surrounding the central beam; a second field component, on the other hand, intersects in the same direction, the two side beams and has a negligible field strength close to the central beam. In order to adjust the static convergence of the side beams of a picture tube with a device of this type it is necessary to find the right combination of fields by rotating four magnetised rings of which two displace the side beams in the same direction and two displace the paths of the beams in opposite directions.

In use of such a device the angular positions of the two rings of the first pair are adjusted in such a manner as to obtain the required direction and intensity of the first field component; the angular positions of the two rings of the second pair are then adjusted in such a manner as to obtain the required direction and intensity of the second component of the field. Since each of the four controls influences all the others, the convergence control is laborious and must be carried out as a process of successive approximation be highly skilled personnel.

The present invention seeks to provide a magnetic controllable unit for obtaining adjustment of the static convergence of the beams of an in-line gun television picture tube in an easy and simple manner in which no single control appreciably influences the other controls.

The present invention also seeks to provide a magnetic unit which can be used to achieve both the static and the dynamic convergence of the electron beams.

According to the present invention, there is provided a device for adjusting the convergence of the side beams of a colour television picture tube with three in-line electron guns located in a neck of the picture tube for generating three electron beams one of which is substantially coincident, in the absence of any deflecting forces, with the longitudinal axis of the neck of the picture tube, and the other two of which are substantially symmetrically disposed on opposite sides of the said axis, the three electron beams passing through a region within the neck of the picture tube which is free of magnetisable structures, characterised in that it comprises a first unit adapted to be mounted on the neck of the picture tube for producing a controllable magnetic field which is such as to cause displacement in one direction of only one of the said side beams without appreciably altering the path of the other two beams.

Figure 1B:
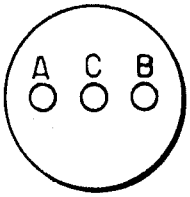
Figure 2:
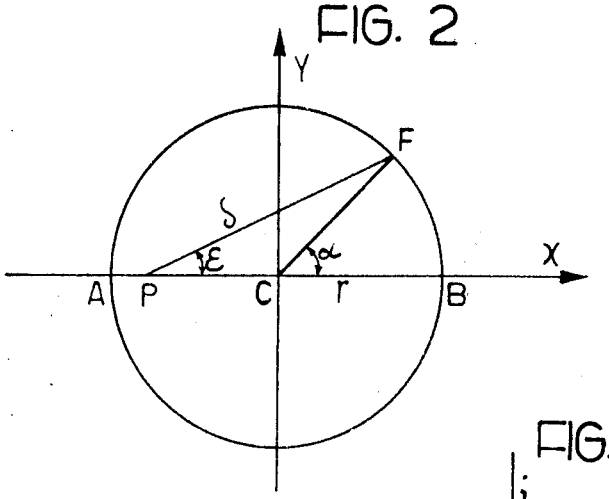
Figure 5A:
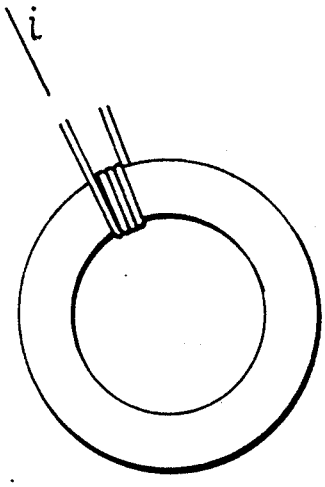
Figure 5B:
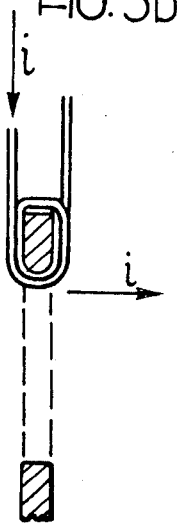
Figure 3A:
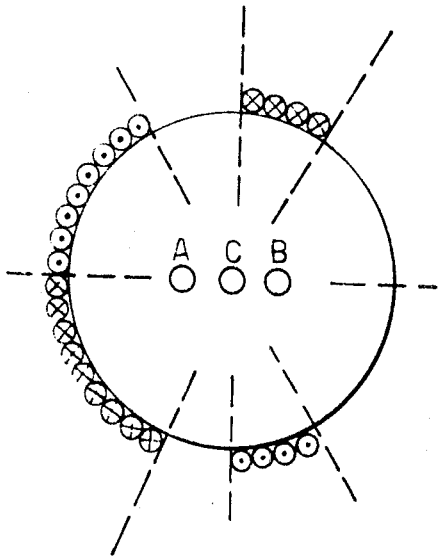
Figure 3B:
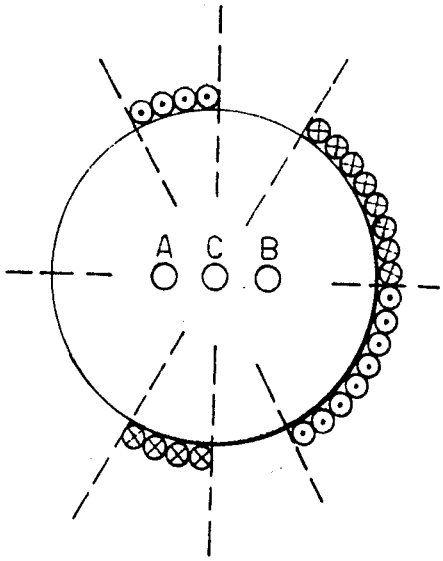
Figure 4A:
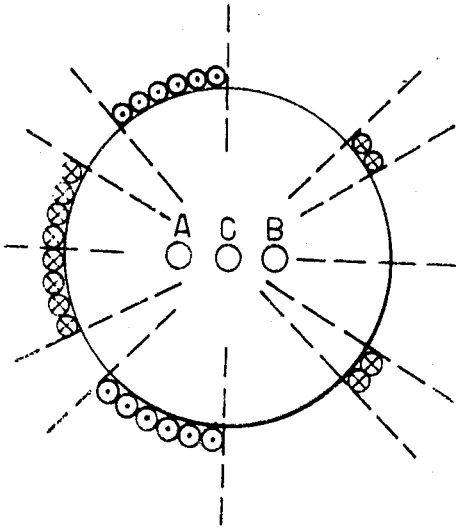
Figure 4B:
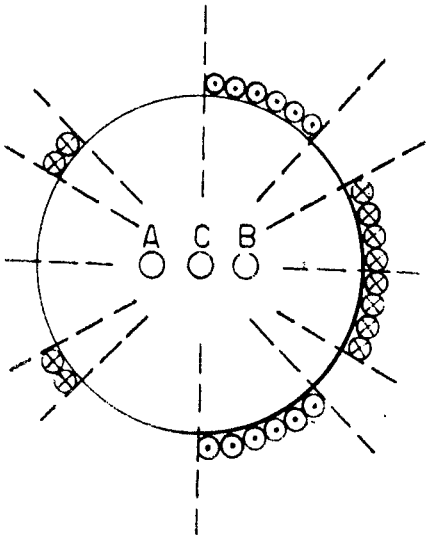
Figure 6:
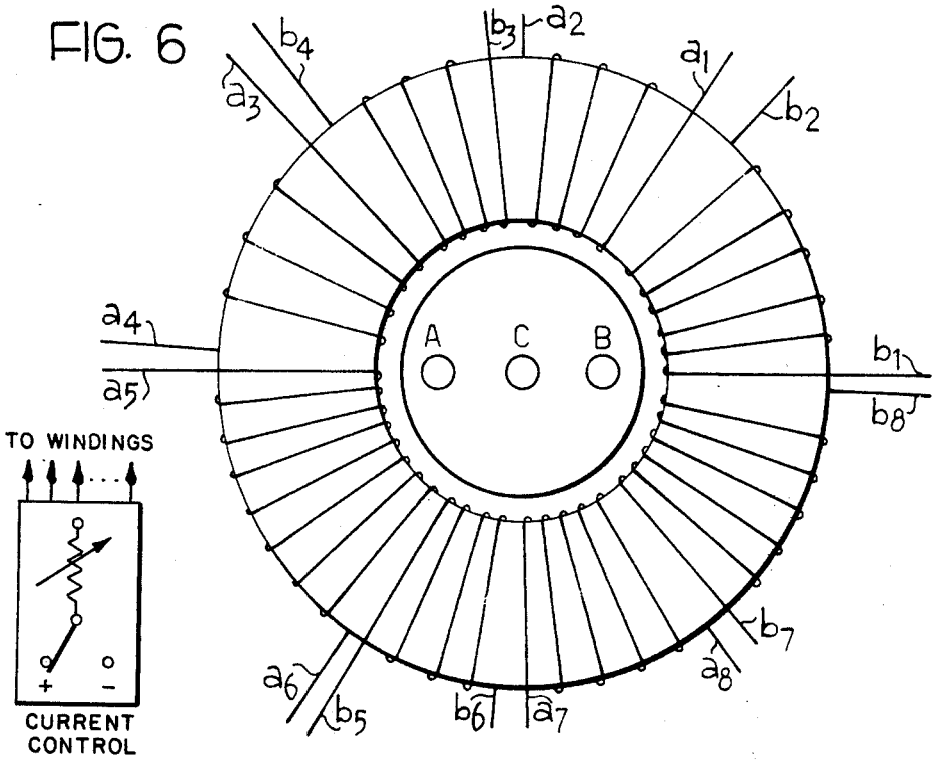
Figure 7:
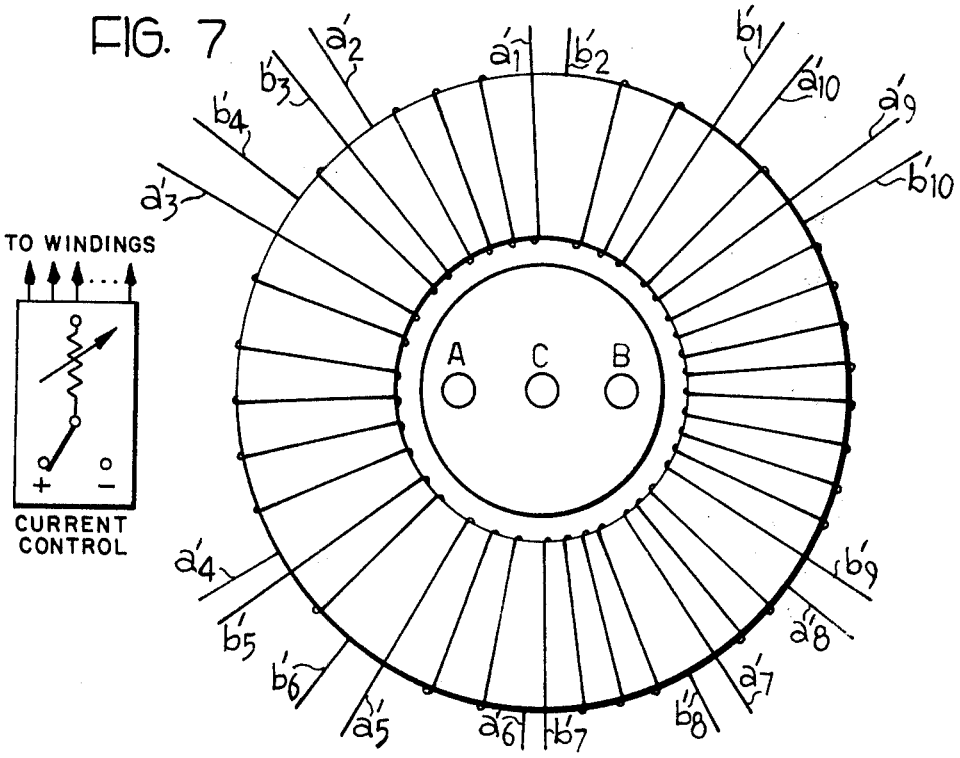

Embodiments of the invention will now be more particularly described, by way of example with reference to the accompanying drawings, in which:

FIGS. 1*a* and 1*b* are schematic representations of a colour television picture tube, showing the associated deflection yoke;

FIG. 2 is a diagram useful for explaining the operation of the device of the present invention;

FIGS. 3*a* and 3*b* schematically represent a first distribution of elementary electrical currents in a first exemplary embodiment of the invention;

FIGS. 4*a* and 4*b* schematically represent a second distribution of elementary electrical currents in a second exemplary embodiment of the invention;

FIGS. 5*a* and 5*b* schematically represent a single winding illustrating the manner in which windings would be wound in embodiments of the invention;

FIG. 6 schematically represents a magnetic unit formed as a part of an embodiment of the invention; and FIG. 7 schematically represents a magnetic unit formed a a further part of an embodiment of the present invention.

Referring now to the drawings, and particularly to FIGS. 1*a* and 1*b*, there is shown a colour television picture tube with three guns A, B, C in line, that is to say a central gun C and two side guns A and B. In order to correct the static convergence error, that is to correct the non-coincidence of the beams of the three guns A, B, C at the centre of the screen of the picture tube in the absence of a magnetic field generated by the deflection yokes, it is known to use one or more devices which generate a magnetic field the intensity and direction of which effects the appropriate correction. Such devices are mounted on the neck of the tube in the area indicated S in FIG. 1*a*, between the guns A, B, C and the deflection yoke of the tube.

Such convergence correcting devices are normally formed in such a manner as not to influence the central gun C but instead to influence simultaneously, and in a suitable manner, the side guns A and B. Devices formed as embodiments of the present invention, on the other hand are so constructed that they generate a magnetic field which affects each of the side beams in a manner independent from one another. Such a device has a part which only influences the beam generated by gun A and a part which only influences the beam generated by gun B; moreover, each part, which influences the beam generated by one gun, comprises two parts, one part for causing displacement of the beam on the screen in a direction parallel to the line joining the three guns (a horizontal displacement if the guns are aligned in this manner) and a part which acts on the beam in such a manner as to cause displacement thereof in a direction orthogonal to the preceding one. The four parts of the device may be made in such a manner that they do not influence one another so that, as will be demonstrated below, they can be mechanically coupled together and yet retain the individual controls which are all entirely independent from one another. Embodiments of the present invention can also be adapted for the dynamic correction of the convergence when they are suitably controlled (by techniques which will be known to the man skilled in the art).

For the purpose of the following discussion of the criteria and conditions which must be fulfilled by embodiments of the present invention in order to operate in the manner defined above, reference will be made to FIG. 2, in which the points A, C and B respectively which have co-ordinates $(-r,o)$, $(o,o)$ and $(r,o)$ respectively represent the three guns A, C, B of the picture tube (see FIG. 1*b*), and the circle with its centre at point C and passing through the points A and B represents the locus of the elementary electric currents which generate the magnetic field required. Without prejudice to the generality of the discussion it is assumed that a constant current '*i*' flowing in a direction normal to the plane of the paper crosses the points lying on the circumference of the circle described hereinabove.

First considering a point 'P' on the *x* axis and a point 'F' on the circumference of the circle.

Let, $\delta$ = the distance between the point P and the point F $r$ = the distance between the point C and the point F (radius of the circle)

$\epsilon$ = the angle $F\hat{P}C$ $\alpha$ = the angle $F\hat{C}B$

It can be shown that the amount of flux induced at point 'P' by the current '*i*' which flows into point 'F' in a direction normal to the *x*, *y* plane is given by:

$$dH = (i/4\pi)\,(d(r\alpha)/\delta\,2) \tag{1}$$

where the direction of the flux dH is normal to the plane passing through the point 'P' and the straight line passing through the point 'F' normal to the *x*, *y* plane.

The components $dH_x$ and $dH_y$ in the *x* and *y* directions respectively, can be expressed as:

$$dH_x = \frac{i}{4\pi}\;\frac{d(r\alpha)}{\delta 2}\sin\epsilon \tag{1a}$$

$$dH_y = \frac{i}{4\pi}\;\frac{d(r\alpha)}{\delta 2}\cos\epsilon \tag{1b}$$

From FIG. 2 it can be shown that $$\delta^2 = r^2\left[(1+\frac{xp}{r})^2 - 4\frac{xp}{r}(\cos\frac{\alpha}{2})^2\right] \tag{2a}$$

$$\sin\epsilon = \frac{r\sin\alpha}{\delta} \tag{2b}$$

where *xp* is the value of the abcissa at the point 'P', and therefore for point A it will be seen that $xp = ir$, whereas for point B, $xp = r$, and for point C, $xp = 0$. Now taking into account that $d(r\alpha) = rd\,\alpha$, for the point 'C' we have the following relations:

$$dH_x^c = \frac{i}{4\pi r}\sin\alpha d\alpha \tag{3a}$$

$$dH_y^c = \frac{i}{4\pi r}\cos\alpha d\alpha \tag{3b}$$

and for point A the following relations apply:

$$dH_x^a = \frac{i}{8\pi r}\;\frac{\mathrm{Sin}\frac{\alpha}{2}}{(\cos\frac{\alpha}{2})^2}\,d\frac{\alpha}{2} \tag{4a}$$

$$dH_y^a = \frac{i}{8\pi r}\;\frac{1}{\cos\frac{\alpha}{2}}\,d\frac{\alpha}{2} \tag{4b}$$

With regard the point B the field generated by the currents '*i*' which flow through the points lying on the circumference of the circle is rotated by $\pi$ and therefore it is possible to define as $i(\alpha)$ the function which describes the distribution of the current on the circumference of the circle in terms of the angle $\alpha$; for the point B the expressions (4*a*) and (4*b*) can be used where, $i(\alpha)$ is replaced by $i(\alpha+\pi)$.

Thus, the values of the fluxes induced at the points A, B and C by a general current distribution $i(\alpha)$ are defined as follows:

$$H_x^a = \frac{1}{8\pi r}\int_{-\pi}^{\pi} i(\alpha)\,\frac{\mathrm{Sin}\frac{\alpha}{2}}{(\cos\frac{\alpha}{2})^2}\,d\frac{\alpha}{2} \tag{5a}$$

$$H_y^a = \frac{1}{8\pi r}\int_{-\pi}^{\pi} i(\alpha)\,\frac{1}{\cos\frac{\alpha}{2}}\,d\frac{\alpha}{2} \tag{5b}$$

$$H_x^b = \frac{1}{8\pi r}\int_{-\pi}^{\pi} i(\pi+\alpha)\,\frac{\sin\frac{\alpha}{2}}{(\cos\frac{\alpha}{2})^2}\,d\frac{\alpha}{2} \tag{6a}$$

$$H_y^b = \frac{1}{8\pi r}\int_{-\pi}^{\pi} i(\pi+\alpha)\,\frac{1}{\cos\frac{\alpha}{2}}\,d\frac{\alpha}{2} \tag{6b}$$

$$H_x^c = \frac{1}{4\pi r}\int_{-\pi}^{\pi} i(\alpha)\sin\alpha d\alpha \tag{7a}$$

$$H_y^c = \frac{1}{4\pi r}\int_{-\pi}^{\pi} i(\alpha)\cos\alpha d\alpha \tag{7b}$$

These equations can also be expressed as follows:

$$\text{bis } H_x^b = \frac{1}{4\pi r}\int_{o}^{\pi}\frac{i(\alpha)-i(-\alpha)}{2}\;\frac{\sin\alpha/2}{(\cos\alpha/2)^2}\,d\,\alpha/2 \tag{5a}$$

-continued $$\text{bis } H_y^a = \frac{1}{4\pi r} \int_0^{\pi} \frac{i(\alpha)+i(-\alpha)}{2} \frac{1}{\cos \alpha/2} d\,\alpha/2 \tag{5b}$$

$$\text{bis } H_x^b = \frac{1}{4\pi r} \int_0^{\pi} \frac{i(\pi+\alpha)-i(\pi-\alpha)}{2} \frac{\sin \alpha/2}{(\cos \alpha/2)^2} d\,\alpha/2 \tag{6a}$$

$$\text{bis } H_y^b = \frac{1}{4\pi r} \int_0^{\pi} \frac{i(\pi+\alpha)+i(\pi-\alpha)}{2} \frac{1}{\cos \alpha/2} d\,\alpha/2 \tag{6b}$$

$$\text{bis } H_x^c = \frac{1}{2\pi r} \int_0^{\pi} \frac{i(\alpha)-i(-\alpha)}{2} \sin \alpha d\alpha \tag{7a}$$

$$\text{bis } H_y^c = \frac{1}{2\pi r} \int_0^{\pi} \frac{i(\alpha)+i(-\alpha)}{2} \cos \alpha d\alpha \tag{7b}$$

In the following discussion $i(\alpha)$ is defined as an odd function if $i(\alpha) = -i(-\alpha)$ and therefore because $i(\alpha)$ is periodic with a period $2\pi$ the result is that $i(\pi+\alpha) = -i(-\pi-\alpha) = -i(\pi-\alpha)$.

Likewise $i(\alpha)$ is defined as an even function if $i(\alpha) = i(-\alpha)$ and therefore $i(\pi+\alpha) = i(\pi-\alpha)$. Then if $i(\alpha)$ is an odd function the result is that $H_y^a = H_y^b = H_y^c = 0$ and if $i(\alpha)$ is an even function the result is that $H_x^a = H_x^b = H_x^c = 0$.

Thus, according as to whether $i(\alpha)$ is an odd function or an even function the field generated at points A, B, C is either in the direction $x$ only or in the direction $y$ only.

Considering now the case in which $i(\alpha)$ is an odd function, that is to say $$i(\alpha) = -i(-\alpha);\ i(\pi+\alpha) = -i(\pi-\alpha) \tag{8}$$

in this case:

$$H_y^a = H_y^b = H_y^c = 0 \tag{9}$$

$$H_x^a = \frac{1}{4\pi r} \int_0^{\pi} i(\alpha) \frac{\sin \alpha/2}{(\cos \alpha/2)^2} d\,\alpha/2 \tag{10a}$$

$$H_x^b = \frac{-1}{4\pi r} \int_0^{\pi} i(\pi-\alpha) \frac{\sin \alpha/2}{(\cos \alpha/2)^2} d\,\alpha/2 \tag{10b}$$

$$H_x^c = \frac{1}{2\pi r} \int_0^{\pi} i(\alpha) \sin \alpha d\alpha \tag{10c}$$

Which can be written out as follows:

$$\text{bis } H_x^a = \frac{1}{4\pi r} \int_0^{\pi/2} i(2\alpha)\, d \frac{1}{\cos \alpha} \tag{10a}$$

$$\text{bis } H_x^b = \frac{-1}{4\pi r} \int_0^{\pi/2} i(\pi-2\alpha)\, d \frac{1}{\cos \alpha} \tag{10b}$$

$$\text{bis } H_x^c = \frac{-1}{2\pi r} \int_0^{\pi/2} [i(\alpha)+i(\pi-\alpha)]\, d \cos \alpha \tag{10c}$$

On the other hand if $i(\alpha)$ is an even function, that is if:

$$i(\alpha) = i(-\alpha);\ i(\pi+\alpha) = i(\pi-\alpha) \tag{11}$$

then:

$$H_x^a = H_x^b = H_x^c = 0 \tag{12}$$

$$H_y^a = \frac{1}{4\pi r} \int_0^{\pi} i(\alpha) \frac{1}{\cos \alpha/2} d\alpha/2 \tag{13a}$$

$$H_y^b = \frac{-1}{4\pi r} \int_0^{\pi} i(\pi-\alpha) \frac{1}{\cos \alpha/2} d\alpha/2 \tag{13b}$$

-continued $$H_y^c = \frac{1}{2\pi r} \int_0^{\pi} i(\alpha) \cos \alpha d\alpha \tag{13c}$$

Which can also be written out as follows:

$$\text{bis } H_y^a = \frac{1}{4\pi r} \int_0^{\pi/2} i(2\alpha)\, d \log \tan (\alpha/2 + \pi/4) \tag{13a}$$

$$\text{bis } H_y^b = \frac{-1}{4\pi r} \int_0^{\pi/2} i(\pi-2\alpha)\, d \log \tan (\alpha/2 + \pi/4) \tag{13b}$$

$$\text{bis } H_y^c = \frac{1}{2\pi r} \int_0^{\pi/2} [i(\alpha) - i(\pi-\alpha)]\, d \sin \alpha \tag{13c}$$

The groups of expressions (10)bis and (13)bis thus define the relation between the current distributions '$i$' and the magnetic fluxes at the three points A, B, C.

For the purpose of the present invention four general current distributions are of particular interest, these are:

n.1: in which $H_x^a \neq 0$ and all the other H are null n.2: in which $H_x^b \neq 0$ and all the other H are null n.3: in which $H_y^a \neq 0$ and all the other H are null n.4: in which $H_y^b \neq 0$ and all the other H are null.

From the previous discussion it will be seen that the distributions n.1 and n.2 are generated if $i(\alpha)$ is an odd function, whilst the distributions n.3 and n.4 are generated if $i(\alpha)$ is an even function.

Considering the two cases separately; first, if $i(\alpha)$ is an odd function and therefore the magnetic field is in only the direction $x$ as defined by the formulae (10)bis, in order to obtain the distributions n.1 and n.2 defined above it would be necessary to put, in the first instance:

$$H_x^c = 0 \tag{14a}$$

if expression (10$c$)bis is written out as follows:

$$H_x^c = \frac{1}{2\pi r} \int_0^{\pi/2} [i(\alpha) + i(\pi-\alpha)] \sin\alpha d\alpha \tag{14b}$$

and bearing in mind that $\sin\alpha \geqq 0$ for $0 \leqq \alpha \leqq \pi/2$, it can can be seen that $i(\alpha)$ in the field $0 \leqq \alpha \leqq \pi$ must be capable of assuming positive and negative values in such a manner as to cancel out the integral (14$b$). Now, defining $A^+$ as the assembly of points in $\alpha$ in which $i(\alpha)$ assumes positive values and $A^-$ the assembly of points in $\alpha$ in which $i(\alpha)$ assumes negative values, the integral (14$a$) and expression (14$b$) can be written out as:

$$H_x^c = \frac{1}{2\pi r} \left[ \int_{A^+} i(\alpha) \sin\alpha d\alpha + \int_{A^-} i(\alpha) \sin\alpha d\alpha \right] = 0 \tag{14c}$$

and therefore:

$$\int_{A^+} |i(\alpha)| \sin\alpha d\alpha = \int_{A^-} |i(\alpha)| \sin\alpha d\alpha \tag{14d}$$

Considering expressions (10$a$) and (10$b$), which represent respectively $H_x^a$ and $H_x^b$, and bearing in mind that the sub-integral quantity $\sin\alpha/2\ /(\cos\alpha/2)^2$ always assumes values equal to or greater than zero if $0 \leqq \alpha \leqq \pi$, the two integrals can be written out thus:

$$H_r^a = \frac{1}{4\pi r}\left\{ \int_{A^+} |i(\alpha)| \frac{\sin\alpha/2}{(\cos\alpha/2)^2} d\alpha/2 - \int_{A^-} |i(\alpha)| \frac{\sin\alpha/2}{(\cos\alpha/2)^2} d\alpha/2 \right\} \quad (15a)$$

$$H_r^b = \frac{1}{4\pi r}\left\{ \int_{A^-} |i(\alpha)| \frac{\cos\alpha/2}{(\sin\alpha/2)^2} d\alpha/2 - \int_{A^-} |i(\alpha)| \frac{\cos\alpha/2}{(\sin\alpha/2)^2} d\alpha/2 \right\} \quad (15b)$$

Now, because the two previously described assemblies of points $A^+$ and $A^-$ are mutually exclusive, it can be seen from (15*a*) and (15*b*) that the value of $H_x^a$ is essentially determined by the value of $i(\alpha)$ around the point $\alpha=\pi$, whereas the value of $H_x^b$ is essentially determined by the value of $i(\alpha)$ around the point $\alpha=0$; it is therefore possible to select the distribution of $i(\alpha)$ which at the same time satisfies the expression (14*d*) and is such that $|H_x^a| >> |H_x^b|$ (thereby obtaining a current distribution which approximates to that of n.1) or one which is such that $|H_x^a| >> |H_x^b|$ (thereby obtaining a current distribution which approximates to n.2).

Of course once a current distribution defined by a function $i(\alpha)$ such that it approximates to the distribution n.1 has been obtained another current distribution which approximates to the distribution n.2 can be obtained from it by a simple rotation through 180° as can be seen from expressions (10*a*) and (10*b*) if the constant condition is imposed that for all values of $\alpha$: $i(\alpha) \gtrless 0$; $i(\pi-\alpha) = 0$ vice versa. In this case the two distributions n.1 and n.2 can lie on the same circumference; furthermore there will be no mutual influence between the two distributions if each of these generate a null field along the whole circumference. This is immediately confirmed by the fact that the function $i(\alpha)$ which determines the distribution is an odd function by very definition.

Thus, the distribution n.1 is well approximated by a function $i(\alpha)$ such that $$\begin{cases} i(\alpha) = -i(-\alpha) \\ \int_0^{\pi} i(\alpha)\sin\alpha d\alpha = 0 \\ \left| \int_0^{\pi/2} i(2\alpha)\, d\frac{1}{\cos\alpha} \right| >> \left| \int_0^{\pi/2} i(\pi - 2\alpha)\, d\frac{1}{\cos\alpha} \right| \end{cases} \quad (16a)$$

The distribution n.2 is well approximated by a function $i(\pi+\alpha)$ which satisfies the conditions (16*a*). If, furthermore:

$$i(\alpha) \times i(\pi+\alpha) = 0 \text{ for } 0 \leqq \alpha \leqq \pi \quad (16b)$$

The current distributions can then be achieved on a single circumference, without any interference between them.

Turning now to the case in which the current distribution $i(\alpha)$ is an even function, and therefore the magnetic field is only in the direction $y$ as defined by the formula (13)bis. The above discussion with respect to the case in which $i(\alpha)$ is an odd function is also relevant bearing in mind that in this latter case the current distributions n.3 and n.4 can be achieved, and that if in this case the following condition is imposed, that is:

$$i(\alpha) \times i(\pi+\alpha) = 0 \text{ for } 0 \leqq \alpha \leqq \pi,$$

for the current distributions to be achieved on a single circumference, so as not to have any interference between the two it will be necessary to impose the condition that the integral of the function $i(\alpha)$ in the field $0 \leqq \alpha \leqq \pi$ be zero.

It will thus be appreciated that the distribution n.3 is well approximated by a function $i(\alpha)$ such that $$\begin{cases} i(\alpha) = -i(-\alpha) \\ \int_0^{\pi} i(\alpha)\sin\alpha d\alpha = 0 \\ \left| \int_0^{\pi/2} (2\alpha) d \ln\tan(\alpha/2 + \pi/2) \right| >> \left| \int_0^{\pi/2} i(\pi - 2\alpha) \ln\tan(\alpha/2 + \pi/2) \right| \end{cases} \quad 17(a)$$

The distribution n.4 is well approximated by a function $i(\pi+\alpha)$ which satisfies the conditions (17*a*). If furthermore $$\begin{cases} i(\alpha) \times i(\pi + \alpha) = 0 \text{ for } 0 \leqq \alpha \leqq \pi \\ \int_0^{\pi} i(\pi)\, d\alpha = 0 \end{cases} \quad (17b)$$

then the two distributions, can be achieved on a single circumference without any interference with one another.

Now considering an odd function $i(\alpha)$ defined as follows:

$$\begin{cases} 0 \leqq \alpha \leqq \pi/3 & i(\alpha) = 0 \\ \pi/3 \leqq \alpha \leqq \pi/2 & i(\alpha) = 1 \\ \pi/2 \leqq \alpha \leqq 2/3\pi & i(\alpha) = 0 \\ 2/3\pi \leqq \alpha \leqq \pi & i(\alpha) = -1 \end{cases} \quad (18)$$

and checking it under the conditions set out in relation to (16*a*):

$i(\alpha) = -i(\alpha)$ by definition: I)

$$\int_0^{\pi} i(\alpha)\sin\alpha d\alpha = \int_{\pi/3}^{\pi/2} \sin\alpha d\alpha - \int_{2/3\pi}^{\pi} \sin\alpha d\alpha = \quad \text{II)}$$

$$= \cos\pi/3 - \cos\pi/2 - \cos 2/3\pi + \cos\pi =$$

$$= 1/2 - 0 - (-1/2) + (-1) = 0$$

Thus the condition is satisfied.

III)

$$\left| \int_{\pi/6}^{\pi/4} d\frac{1}{\cos\alpha} - \int_{\pi/3}^{\pi/2} d\frac{1}{\cos\alpha} \right| >> 0 \left| \int_{\pi/4}^{\pi/3} \frac{1}{\cos\alpha} - \int_0^{\pi/6} d\frac{1}{\cos\alpha} \right|$$

From which $$\left| \frac{1}{\cos\pi/4} - \frac{1}{\cos\pi/6} - \frac{1}{\cos\pi/2} + \frac{1}{\cos\pi/3} \right| >>$$

-continued $$\left|\frac{1}{\cos\pi/3} - \frac{1}{\cos\pi/4} - \frac{1}{\cos\pi/6} + \frac{1}{\cos 0}\right|$$

Therefore:

$$\left|\sqrt{2} - \frac{2}{\sqrt{3}} - \infty + 2\right| >> \left|2 - \sqrt{2} - \frac{2}{\sqrt{3}} + 1\right|$$

$$|-\infty| >> |0.431|$$

and therefore the condition is satisfied. Moreover the condition imposed by the relation (16*b*) is satisfied because $$i(\alpha) \times i(\pi+\alpha) = 0 \text{ for } 0 \leqq \alpha \leqq \pi$$

and therefore as previously mentioned the odd function represented by (18) approximates to the distribution n.1 and, when rotated by 180° approximates to the distribution n.2.

FIG. 3 represents a practical realisation of such a distribution, in which FIG. 3*a* represents the distribution n.1 and FIG. 3*b* represents the distribution n.2.

As can easily be observed from FIG. 3 windings for achieving the two distributions can be wound on the same support since the windings are complementary to one another on the circumference; the two windings do not influence one another.

Considering now an even function $i(\alpha)$ defined as follows:

$$\begin{cases} 0 \leqq \alpha \leqq \pi/6 & i(\alpha) = 0 \\ \pi/6 \leqq \alpha \leqq \pi/4 & i(\alpha) = 1 \\ \pi/4 \leqq \alpha \leqq \pi/2 & i(\alpha) = 0 \\ \pi/2 = \alpha \leqq (3/4)\pi & i(\alpha) = -1 \\ (3/4)\pi \leqq \alpha \leqq (5/6)\pi & i(\alpha) = 0 \\ (5/6)\pi \leqq \alpha \leqq \pi & i(\alpha) = 1 \end{cases} \quad 19)$$

and checking it under the conditions imposed by the relation (17*a*)

$$i(\alpha) = i(-\alpha) \text{ by definition;} \quad \text{I)}$$

$$\int_0^{\pi} i(\alpha)\cos\alpha d\alpha = \int_{\pi/6}^{\pi/4} \cos\alpha d\alpha - \int_{\pi/2}^{3/4\pi} \cos\alpha d\alpha \quad \text{II)}$$

$$+ \int_{5/6\pi}^{\pi} \cos\alpha d\alpha = \sin\pi/4 - \sin\pi/6 - \sin 3\pi/4$$

$$+ \sin\pi/2 + \sin\pi - \sin 5\pi/6 = \frac{1}{\sqrt{2}} - \frac{1}{2}$$

$$- \frac{1}{\sqrt{2}} + 1 + 0 - \frac{1}{2} = 0$$

and thus the condition is satisfied:

$$\left| \int_{7/24\pi}^{5/16\pi} d\ln\tan\alpha - \int_{7/8\pi}^{7/16\pi} d\ln\tan\alpha + \int_{11/24\pi}^{\pi/2} d\ln\tan\alpha \right| >> \quad \text{III)}$$

$$\left| \int_{\pi/4} d\ln\tan\alpha - \int_{5/16\pi} d\ln\tan\alpha + \int_{7/16\pi} d\ln\tan\alpha \right|$$

that is to say:

$$|(0.403 - 0.264) - (1.614 - 0.881) + (\infty - 2.027)| >>$$

$$|(0.264 - 0) - (0.881 - 0.403) + (2.027 - 1.614)|$$

$$|\infty| >> |0,199|$$

and thus the condition is satisfied. Furthermore for the conditions imposed by the relation (17*b*) $i(\alpha) \times i(\pi+\alpha) = 0$ is verified;

$$i(\alpha)\, d\alpha = \pi/4 - \pi/6 - 3/4\pi + \pi/2 + \pi - 5/6\pi = \\ = \pi/12\,(3 - 2 - 9 + 6 + 12 - 10) = 0$$

Thus, again, the condition is satisfied and therefore the even function represented by the expressions (19) approximates to the distribution n.3 and, when rotated through 180°, approximates to the distribution n.4.

FIG. 4 represents a practical realisation of such a distribution; in particular FIG. 4*a* represents the distribution n.3 and FIG. 4*b* the distribution n.4. As can be seen from these Figures the two distributions can readily be wound on the same support because the windings are complementary to one another on the circumference. The two windings do not influence one another.

It is therefore possible to produce devices which, when mounted on the neck of a colour television picture tube with in-line guns, make it possible to adjust the static convergence of each side beam independently of the other beam, and, moreover, each beam can be independently adjusted in the horizontal direction and in the vertical direction. This much simplifies the adjustment of the static convergence because the various controls are independent of one another so that it is possible to make any necessary adjustment simply by operating on one of the controls, as opposed to previous systems which require a plurality of operations in order to adjust the static convergence of both side beams in a manner which successively approximates to the required adjustment, and the success of which complex operation depends essentially on the skill of the operator.

The device of the present invention defined above can be made with rings on which coils of conductive wire are wound and in which a given current is caused to flow. In FIGS. 5*a* and 5*b* is illustrated one form in which the coils may be wound on the support ring, which latter can be made either of insulating material or of ferro-magnetic material, although the precise form of the windings on the ring may be any which satisfies, for each control device, the conditions which have been established above. Of course, in the above discussion consideration has been given only to the current which flows in a circumferential element of a coil on the ring to determine its contribution to the field produced on the individual beams; in a practical construction, however, each element forms part of a whole turn of a coil wound on the support. In FIGS. 3 and 4 are shown elementary conductors in which the current flows in opposite directions; this can be achieved in practice with coils all wound in the same sense simply by reversing the direction of current flow through some of the coils with respect to that flowing through others, for example by inverting the input and output terminals of some of the coils, with a common source feeding all coils. As shown in FIGS. 5*a* and 5*b* the windings preferably have a single layer of turns uniformly wound around the circumference of the ring; these windings preferably extend right around the ring and are interconnected in such a manner as to obtain the required field distribution as will be described in greater detail below.

FIGS. 6 and 7 illustrate one embodiment of the invention in which only two rings are required to form the four parts of the device for achieving both the horizontal and vertical adjustment of the two side beams of a colour television picture with in-line guns, for the purpose of correcting the static convergence. This embodiment may also be used for correction of the dynamic convergence, if the windings are fed with a suitable line frequency or raster frequency current, or both.

The various windings of the embodiment shown in FIGS. 6 and 7 all turn in the same direction and are such that the density of turns around the whole circumference of the rings is uniform; moreover the coils formed by the turns are all adjacent to each other without any gaps. As shown in Figure the control ring is mounted, in use, on the neck of a television picture tube and orientated, in relation to the plane defined by the electron beams producing the three guns respectively indicated by A and B for the side guns and by C for the central gun, in the manner shown. The terminals of the various windings are indicated by the reference letters $a_1$ to $a_8$ for one set of windings for effecting displacement of the beam produced by the gun A, and by $b_1$ to $b_8$ for the other set of windings for effecting displacement of the beam generated by the gun B. Each winding has two terminals and will be indicated hereinafter by reference to these terminals. Thus the set of windings for controlling the beam A comprise four windings $a_1 a_2$, $a_3 a_4$, $a_5 a_6$ and $a_7 a_8$, and correspondingly the other set comprises four windings $b_1 \ldots b_8$. The windings $a_1 a_2$ and $a_7 a_8$, and the windings $b_3 b_4$ and $b_5 b_6$ are identical to one another and each occupies 1/12 of the whole circumference of the ring; likewise the windings $a_3 a_4$, $a_5 a_6$ and $b_1 b_2$, $b_7 b_8$ are identical to one another and each of these occupies 1/6 of the entire circumference of the ring. The arrangement of these windings can be seen more clearly with reference to the elementary conductor shown in FIG. 3, the disposition of which is identical to that of the windings of FIG. 6.

The terminals of the various windings are connected in the following manner: $a_2$ is connected to $a_4$, $a_3$ to $a_5$, $a_6$ to $a_8$; the terminals $a_1$ and $a_7$ are free; likewise the terminal $b_2$ is connected to $b_4$, $b_3$ to $b_5$, $b_6$ to $b_8$, and the terminals $b_1$ and $b_7$ are free. As shown in FIG. 6 the ring is positioned on the neck of a colour television picture tube in such a manner that the point of contact between windings $a_3$ $a_4$ and $a_5$ $a_6$, and the point of contact between the windings $b_1$ $b_2$ and $b_7$ $b_8$ are in line with the three guns A, B, C of the picture tube.

Now if a current source is connected to the free terminals $a_1$ and $a_7$ in such a manner as to cause a D.C. current to flow through the windings of the set $a$ the current will flow in the sense and with the relation illustrated in FIG. 3*a* and will cause displacement in the vertical direction (that is orthogonal to the plane defined by the three guns) of the beam generated by the gun A of FIG. 6 without appreciably influencing the beams generated by the other two guns; the magnitude and the direction of the current fed to the terminals $a_1$ and $a_7$ will determine the amount and the direction of this displacement. Similarly a current source connected across the free terminals $b_1$ and $b_7$ to cause a d.c. current to flow in the windings of the set $b$ will cause a displacement in the vertical direction (again, orthogonal to the plane defined by the three guns), of the beam generated by the gun B of FIG. 6 without appreciably influencing the beams generated by the other two guns; the intensity and the direction of the current fed to the terminals $b_1$ and $b_7$ will determine the amount and direction of the vertical displacement. As previously shown, the two sets of windings indicated $a_1 \ldots a_8$ and $b_1 \ldots b_8$ have a zero coupling with respect to one another and therefore do not influence one another. It is therefore possible to feed these two sets of windings with an A.C. current without there being any interference of one with the other. Therefore the embodiment illustrated is suitable not only for effecting the static correction (by D.C. current), but also it can be used for correction of the dynamic convergence by using a line frequency or raster frequency signal of a form and intensity suitable for such correction.

The control ring illustrated in FIG. 7 has a set of 10 windings which, again, are all wound in the same direction and in such a way that the turns are uniformly spaced over the entire circumference of the ring and are adjacent to each other without any gaps. As in FIG. 6 the ring of FIG. 7 is shown mounted on the neck of a colour television picture tube having three guns respectively indicated A and B for the side guns and by C for the central gun. The terminals of the various windings are again indicated by the references $a_1'$ to $a_{10}'$ and by $b_1'$ to $b_{10}'$, and the individual windings are disposed in the pattern illustrated more clearly in FIG. 3*b*.

The windings $a_7'$ $a_8'$, $a_9'$ $a_{10}'$ and the windings $b_3'$ $b_4'$, $b_5'$ $b_6'$ are identical to each other and each occupies 1/24 of the entire circumference of the ring. The windings $a_1'$ $a_2'$, $a_5'$ $a_6'$; $b_1'$ $b_2'$ and $b_7'$ $b_8'$ are also identical to one another and each of these occupies 1/8 of the entire circumference of the ring; similarly the windings $a_3'$ $a_4'$ and $b_8'$ $b_{10}'$ are identical to one another and each of these occupies 1/6 of the entire circumference of the ring.

The terminals of the various windings of the set $a'$ are interconnected as follows: $a_2'$ to $a_4'$, $a_3'$ to $a_5'$, $a_6'$ to $a_8'$, $a_7'$ to $a_{10}'$ whilst $a_1'$ and $a_9'$ remain free; furthermore the windings of the set $b'$ are interconnected as follows: $b_2'$ to $b_4'$, $b_3'$ to $b_6'$, $b_5'$ to $b_7'$, $b_8'$ to $b_{10}'$ whilst $b_1'$ and $b_9'$ remain free. The ring is positioned on the neck of the picture tube as shown in FIG. 7 in such a way that the point of contact between the windings $a_1'$ $a_2'$ and $b_1'$ $b_2'$, and the point of contact between the windings $a_5'$ $a_6'$ and $b_7'$ $b_8'$ lie on a line orthogonal to the line joining the centers of the three guns. Now, a current source connected across the free terminals $a_1'$ and $a_9'$ will cause a d.c. current to flow through the windings of the set $a'$ with the relative senses indicated in FIG. 4*a*. This will cause a displacement in the horizontal direction (that is to say, parallel to the plane defined by the three guns) of the beam generated by the gun A of FIG. 7, without appreciably influencing the beams generated by the other two guns; the magnitude and direction of the current fed into the terminals $a_1'$ and $a_9'$ will determine the amount and the direction of the horizontal displacement.

Similarly a current source connected across the free terminals $b_1'$ and $b_9'$ to cause a d.c. current to flow through these in the relative senses as indicated in FIG. 4*b*, will cause a horizontal displacement (that is to say parallel to the plane defined by the three guns) of the beam generated by the gun B of FIG. 7 without appreciably influencing the beams generated by the other two guns: the magnitude and the direction of the current fed into the terminals $b_1'$ and $b_9'$ will determine the amount and the direction of this horizontal displacement.

Again, as previously demonstrated the two sets of windings defined by the terminals $a_1'$ $a_9'$ and $b_1'$ $b_9'$ have a zero coupling between one another and therefore the current flowing in one set of windings does not influence any current flowing in the other.

It is therefore possible to feed these windings with an a.c. current without such being transmitted from one winding into the other. Therefore, the embodiment shown in FIG. 7 is suitable not only for effecting static correction of the convergence (by means of a d.c. current) but can also be used for dynamic correction of the convergence either by feeding a signal, at line frequency or at raster frequency, of a form suitable for such a correction.

The two rings illustrated in FIGS. 6 and 7 thus, together, form a device by means of which independent adjustment of the convergence of the two side beams of a colour picture tube with in-line guns in both the $x$ and $y$ direction can be effected by feeding to them appropriate d.c. signals. Thus, only four independent operations are necessary for the control of the static convergence, without any further adjustments being required to those first made after the operation is complete and without the need to proceed by successive approximations as was necessary with previously known correction devices. The embodiment illustrated is only one of a number of possible embodiments.

Of course, every embodiment of the invention which is such that it fulfils the conditions imposed by expressions (16*a*) and (16*b*) permits, in an independent manner, the control of the position of the beams of the two side guns of a television picture tube having in-line guns, in a direction orthogonal to the plane defined by the three guns, so that in this direction they coincide on the screen with the beam generated by the central gun, and every embodiment which fulfils the conditions imposed by expressions (17*a*) and (17*b*) permits, in an independent manner, the control of the beams of the two side guns of a television picture tube with in-line guns in a direction parallel to the plane defined by the three guns so that in this direction they coincide on the screen with the beam generated by the central gun.

The precise form of any particular embodiment selected will depend on the available means for its construction, but, in any case, it will always be necessary to fulfil the above mentioned conditions; it is only these conditions which determine the operation of the device, and, for example, it would be possible to construct the two toroidal windings described in relation to FIGS. 6 and 7 on a single support ring with the second winding, that is that of FIG. 7, being wound in alternate turns with those of the first winding, that is that of FIG. 6.

The advantages offered by the device of the present invention are that correction of static convergence (and also dynamic convergence) can be effected for the two beams of the side guns of a picture tube with in-line guns, in a manner which permits independent adjustment of each beam in both the horizontal and the vertical direction independently. Thus, for each beam of a side gun there can be provided two control elements operable independently of one another; one for effecting displacement in the horizontal direction, and the other for effecting displacement in a vertical direction. Because of this there are only four simple operations required to effect correction for static convergence errors and these are such simple, independent, operations that they can be performed even by unskilled workers.

The control elements for effecting adjustment may be, for example control knobs situated on a front panel of the television set, in which case the operator has the advantage of being able easily to see on the screen the effects of his adjustment. This is much simpler than manipulating rings situated on the neck of the picture tube, which is required by previously known adjustment systems.

What is claimed is:

1. A device for adjusting the convergence of the side beams of a colour television picture tube of a type having:

a neck portion, three in-line electron guns located in said neck portion of the picture tube and operating to produce three electron beams one of which is substantially coincident, in the absence of any deflecting forces, with the longitudinal axis of said neck portion of the picture tube and the other two of which are substantially symmetrically disposed on opposite sides of said axis, a region within said neck of said picture tube which is free of magnetisable structures, said three electron beams passing through said region, said device including a first unit adapted to be mounted on said neck portion of said picture rube and operating to generate a plurality of magnetic fields, which combine together to produce a selectively controllable magnetic field in the region of one of two side beams and a magnetic field practically null in the region of the other two beams, so that it is possible to cause controlled displacement in one predetermined direction of only one of said side beams without appreciably altering the path of said other two beams.

2. A device as in claim 1, wherein there is further provided, a second unit mountable on said neck portion of said picture tube and operating to produce a controllable magnetic field which is such as to cause displacement in a second direction, different from said one direction, of said one of said side beams without appreciably altering the path of said other two beams.

3. A device as claimed in claim 1, wherein said first unit is such as to cause said one direction to be perpendicular to the common plane of said three beams.

4. A device as claimed in claim 2, wherein said second unit is such as to cause said second direction to be in the common plane of said three beams.

5. A device as in claim 1, wherein said first unit incorporates first means operating to produce a controllable magnetic field which causes displacement in said first direction of said one of said two side beams, and second means operating to produce a controllable magnetic field causing displacement in said first direction of said other of said two side beams.

6. A device as in claim 2, wherein said second unit comprises third means operating to produce a controllable magnetic field causing displacement in said second direction of said one of said two side beams and fourth means operating to produce a controllable magnetic field causing displacement in said second direction of said other of said two side beams.

7. A device as in claim 1, wherein said first unit comprises a plurality of conductors through which, in use of said device, flow electric currents, and means for controlling the magnitude and direction of said currents.

8. A device as in claim 2, wherein said second unit comprises a plurality of conductors through which, in use of the device, flow electrical currents, and means for controlling the magnitude and direction of said currents.

9. A device as in claim 8, wherein said plurality of conductors of said first and second units are disposed on respective annular supports and are in the form of toroidal windings.

10. A device as in claim 9, wherein each said annular support is at least partly composed of ferromagnetic material.

11. A device as in claim 9 wherein said first means comprise a plurality of windings of conductive material wound on said annular support and occupying not more than half the overall circumference of said support.

12. A device as in claim 11, wherein said second means comprise a plurality of windings disposed on the same support as said first means and occupying the regions not occupied by said windings of said first means.

13. A device as in claim 9, wherein said third means comprise a plurality of windings of conductive material wound on said annular support and occupying not more than half the overall circumference of said support.

14. A device as in claim 11, wherein said fourth means comprise a plurality of windings disposed on the same support as said third means and occupying the regions not occupied by said windings of said third means.

15. A device as in claim 5, wherein the mutual magnetic coupling between any two of said first, second, third or fourth means is substantially nil.

16. A device as in claim 12, wherein said windings which constitute said first means are positioned such as to be mirror images of the windings which constitute the said second means across a plane orthogonal to that defined by the line joining said three electron guns, and the longitudinal axis of said neck portion of the tube.

17. A device as in claim 12, wherein said windings which constitute said third means are positioned such as to be mirror images of the windings which constitute the said fourth means across a plane orthogonal to that defined by the line joining said three electron guns, and the longitudinal axis of said neck portion of the tube.

18. A device as in claim 9, wherein said windings of said first and second means comprise eight part-toroidal windings, together extending with uniform density of turns entirely around said annular support, said eight coils including:

four small coils seal angularly extending over about 1/12 of the circumference of said annular support, and four large coils, each angularly extending over about 1/6 of the circumference of said annular support and interconnected in two groups of four so as to form a first composite winding constituting said first means and comprising:

two of said large coils disposed as mirror images of one another across the axial plane defined by said three electron guns, but connected so that the current in one flows in the opposite direction to the current in the other, and two of said small coils, disposed as mirror images of one another across the axial plane defined by said electron guns but connected so that the current in one flows in the opposite direction to the current in the other, and a second composite winding constituting said second means and comprising a configuration of coils identical to that of said first means but disposed as a mirror image thereof across the axial plane orthogonal to that defined by said electron guns.

19. A device as in claim 9, wherein said windings of said third and fourth means comprise ten part-toroidal windings, together extending, with a uniform density of turns, around the entire circumference of said annular support, said 10 coils including:

two large coils each angularly extending over about 1/6 of the circumference of the annular support, four intermediate coils each angularly extending over about ⅛ of the circumference of the annular support, and four small coils each angularly extending over about 1/24 of the circumference of the annular support, said coils being interconnected in two groups of five so as to form:

a third composite winding constituting the said third means, and comprising in series;

- one large coil,
- two intermediate coils disposed as mirror images of one another across said axial plane defined by said electron guns, and
- two small coils also disposed as mirror images of one another across the plane defined by said electron guns, and a fourth composite winding constituting said fourth means, and comprising, in series;

- one of said large coils,
- two of said intermediate coils, and
- two of said small coils in a configuration which is a mirror image of that of said third composite winding across an axial plane orthogonal to said axial plane defined by said three electron guns.

20. A device as claimed in any one of claim 8, comprising circuit means to feed said conductors with periodic electric current.

21. A device as claimed in any one of claim 8, comprising circuit means for feeding said conductors with direct electric current.

22. A device as claimed in any one of claim 8, comprising circuit means for feeding said conductors with electric current having a direct part and a periodic part.

23. A device as in claim 8, wherein the conductors of said first and second units are wound on a single support.

24. A colour television picture tube having three in-line electron guns and a device for adjusting the convergence of the side beams as in claim 1.

* * * * *